US011369160B2

(12) United States Patent
Page

(10) Patent No.: US 11,369,160 B2
(45) Date of Patent: Jun. 28, 2022

(54) SKIN PROTECTING GARMENT

(71) Applicant: Lucy Page, Ship Bottom, NJ (US)

(72) Inventor: Lucy Page, Ship Bottom, NJ (US)

( * ) Notice: Subject to any disclaimer, the term of this patent is extended or adjusted under 35 U.S.C. 154(b) by 108 days.

(21) Appl. No.: 17/014,522

(22) Filed: Sep. 8, 2020

(65) Prior Publication Data

US 2020/0397083 A1 Dec. 24, 2020

Related U.S. Application Data

(63) Continuation of application No. 16/038,405, filed on Jul. 18, 2018, now Pat. No. 10,765,160.

(60) Provisional application No. 62/533,860, filed on Jul. 18, 2017.

(51) Int. Cl.

| | |
|---|---|
| ***A42B 1/041*** | (2021.01) |
| ***A42B 1/046*** | (2021.01) |
| ***A42B 1/008*** | (2021.01) |
| ***A42B 1/18*** | (2006.01) |
| ***A41D 23/00*** | (2006.01) |
| *A41D 13/05* | (2006.01) |

(52) U.S. Cl.

CPC ..... *A42B 1/008* (2013.01); *A41D 23/00* (2013.01); *A42B 1/041* (2013.01); *A42B 1/046* (2013.01); *A42B 1/18* (2013.01); *A41D 13/0512* (2013.01); *A41D 2400/26* (2013.01)

(58) Field of Classification Search

CPC .... A42B 1/041; A42B 1/046; A41D 2400/26; A41D 23/00

See application file for complete search history.

(56) References Cited

U.S. PATENT DOCUMENTS

| | | | | |
|---|---|---|---|---|
| D518,625 | S | 4/2006 | Barnhouse | |
| 9,402,432 | B2 | 8/2016 | Dean | |
| 2006/0005297 | A1 | 1/2006 | Blecha | |
| 2006/0130213 | A1* | 6/2006 | Mickle | A42B 1/046 2/202 |
| 2007/0113971 | A1 | 5/2007 | Blecha | |
| 2011/0185482 | A1 | 8/2011 | Godfrey | |
| 2013/0139291 | A1 | 6/2013 | Ko | |
| 2015/0057621 | A1 | 2/2015 | Coombs | |
| 2018/0146733 | A1* | 5/2018 | Greenblat | A42B 1/046 |

* cited by examiner

*Primary Examiner* — Katherine M Moran

(74) *Attorney, Agent, or Firm* — Sean R. Wilsusen, Esq.; Carter, DeLuca & Farrell LLP

(57) ABSTRACT

A skin protecting garment includes a back panel, a lower front panel coupled to the back panel, and an upper front panel coupled to the back panel. An upward facing opening is formed by the back panel and the upper front panel. The upward facing opening is dimensioned, shaped and positioned to expose a top of a user's head. A forward facing slit is between the lower front panel and the upper front panel. The forward facing slit is dimensioned, shaped and positioned to expose the user's eyes. The back panel, the lower front panel and the upper front panel are each formed of a material configured to block ultraviolet (UV) light.

14 Claims, 14 Drawing Sheets

SKIN PROTECTING GARMENT

CROSS-REFERENCE TO RELATED APPLICATION

This application is a continuation of U.S. patent application Ser. No. 16/038,405, filed Jul. 18, 2018, which claims priority to U.S. Provisional Patent Application 62/533,860, filed on Jul. 18, 2017, the disclosures of which are incorporated by reference herein in their entirety.

FIELD OF THE INVENTION

The present invention relates to a skin protective garment. One or more exemplary embodiments of the present invention provide a skin protecting garment configured to block ultraviolet (UV) light.

BACKGROUND

Skin cancers are a common form of cancer that arise in the skin. The development of skin cancer is known to be related to exposure to ultraviolet (UV) radiation. Skin cancer is the single most common form of cancer, globally accounting for 40% or more of diagnosed skin cancers. Cancer results from the development of abnormal cells that have the ability to invade or spread to other parts of the body. Common forms of skin cancer include basal-cell skin cancer (BCC), squamous-cell skin cancer (SCC) and melanoma.

Reducing exposure to ultraviolet (UV) radiation and the use of sunscreen may be effective methods of preventing skin cancers, such as for example, basal-cell skin cancer (BCC), squamous-cell skin cancer (SCC) and melanoma.

Sun protective clothing is a type of clothing specifically designed for sun protection by reducing exposure to UV light. Sun protective clothing may include a fabric rated for its level of ultraviolet (UV) protection. Some textiles and fabrics used in sun protective clothing may be pre-treated with UV-inhibiting ingredients during manufacture to enhance their effectiveness, while other fabrics may provide protection from UV light without the additional of additional materials.

SUMMARY

According to an exemplary embodiment of the present invention, a skin protecting garment includes a back panel, a lower front panel coupled to the back panel, and an upper front panel coupled to the back panel. An upward facing opening is formed by the back panel and the upper front panel. The upward facing opening is dimensioned, shaped and positioned to expose a top of a user's head. A forward facing slit is between the lower front panel and the upper front panel. The forward facing slit is dimensioned, shaped and positioned to expose the user's eyes. The back panel, the lower front panel and the upper front panel are each formed of a material configured to block ultraviolet (UV) light.

According to an exemplary embodiment of the present invention, the material configured to block UV light may have an ultraviolet protection factor (UPF) of at least 40.

According to an exemplary embodiment of the present invention, the material configured to block UV light may have an ultraviolet protection factor (UPF) of at least 50.

According to an exemplary embodiment of the present invention, the material configured to block UV light may have an ultraviolet protection factor (UPF) of from about 15 to about 24.

According to an exemplary embodiment of the present invention, the material configured to block UV light may have an ultraviolet protection factor (UPF) of from about 25 to about 39.

According to an exemplary embodiment of the present invention, the material configured to block UV light may include at least one of cotton, nylon, a fabric blend, polyester or microfiber.

According to an exemplary embodiment of the present invention, at least one of the back panel, the lower front panel and the upper front panel may include a moisture-wicking material.

According to an exemplary embodiment of the present invention, at least a portion of the upper front panel may overlap at least a portion of the lower front panel.

According to an exemplary embodiment of the present invention, a skin protecting garment includes a back panel. The back panel is a single continuous textile article including a material configured to block ultraviolet (UV) light. A lower front panel is coupled to the back panel. The lower front panel includes the material configured to block UV light. An upper front panel is coupled to the back panel. The upper front panel includes the material configured to block UV light. An upward facing opening is formed by the back panel and the upper front panel. The upward facing opening is dimensioned, shaped and positioned to expose a top of a user's head. A forward facing slit is between the lower front panel and the upper front panel. The forward facing slit is dimensioned, shaped and positioned to expose the user's eyes.

BRIEF DESCRIPTION OF THE FIGURES

The above and other features of the present invention will become more apparent by describing in detail exemplary embodiments thereof, with reference to the accompanying drawings, in which.

DETAILED DESCRIPTION

Figure 1:
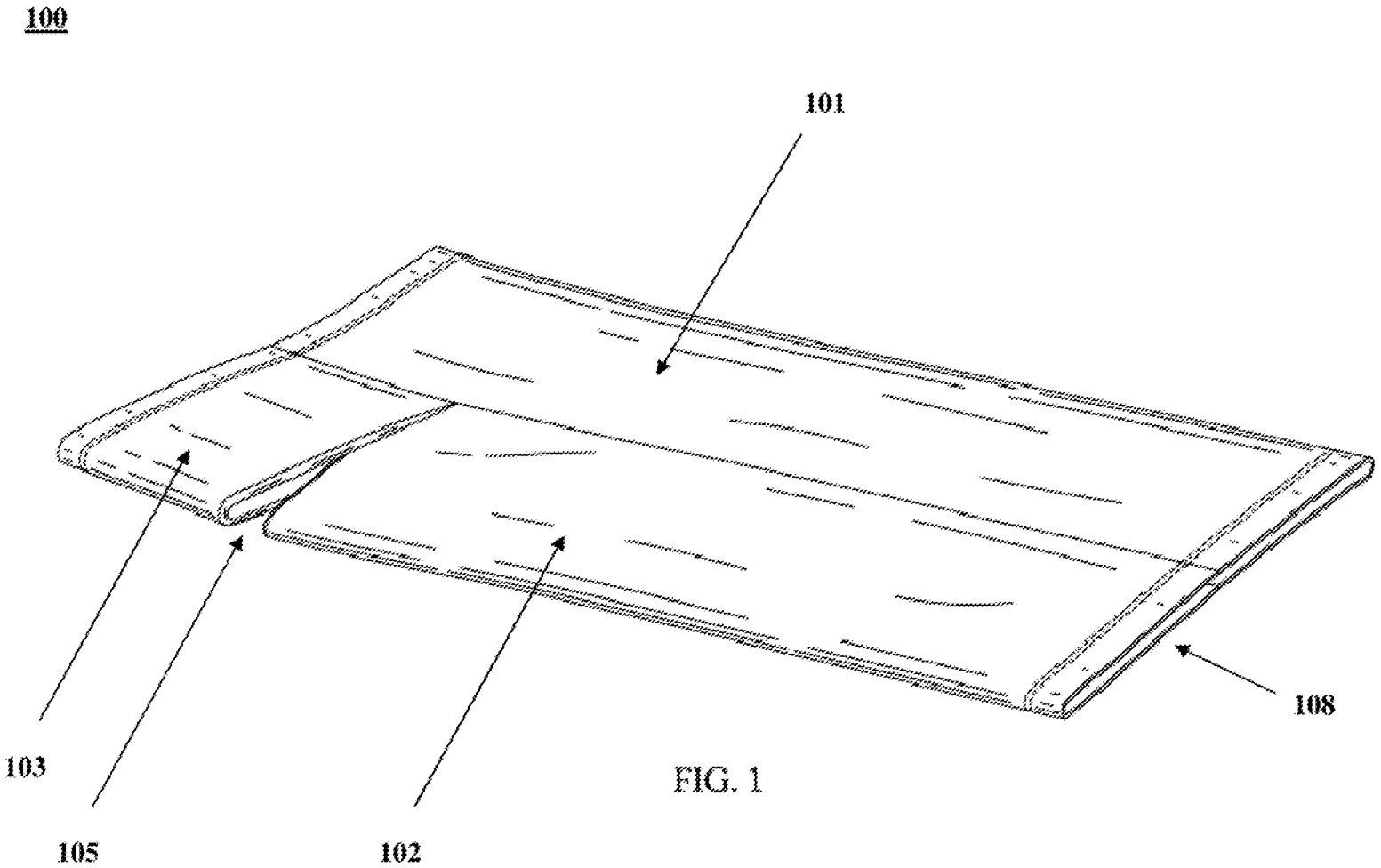
FIG. 1 is a perspective view of a skin protecting garment according to an exemplary embodiment of the present invention.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

Exemplary embodiments of the present invention will be described more fully hereinafter with reference to the accompanying drawings. Like reference numerals may refer to like elements throughout the specification and drawings.

Sun protective clothing may reduce exposure to UV light. Sun protective clothing may include a fabric rated for its level of ultraviolet (UV) protection. Some textiles and fabrics used in sun protective clothing may be pre-treated with UV-inhibiting ingredients during manufacture to enhance their effectiveness, while other fabrics may provide protection from UV light without the additional of additional materials.

One example of a use of such materials is in a skin protecting garment. Such a skin protecting garment may be employed, for example, as a UV protecting garment worn during outdoor activities, such as fishing or boating.

Exemplary Amounts of Blocked UV Radiation Based on UPF Rating

| UPF Rating | % UV radiation Blocked |
|---|---|
| UPF 15-24 | 93.3-95.9 |
| UPF 25-39 | 96.0-97.4 |
| UPF 40-50+ | 97.5-98+ |

The skin protecting garment described herein according to an exemplary embodiment of the present invention may be an accessory garment that is utilized to protect the face (e.g., forehead, cheeks, nose, mouth, and neck) from UV Rays, wind, rain, and snow. The skin protecting garment also doubles as a headband that can be stretched, because of fold feature, to be larger or smaller depending on preference for control of hair and keeping it out of your face while out in the elements and during activities. Exemplary activities in which the skin protecting garment may be useful include fishing, sailing/boating, snowboarding/skiing, hiking, camping, working outside (e.g., as a bug and dust repellant), during festivals (e.g., dust protection), and during other cold weather activities (e.g., as a hat or hat/scarf device).

Figure 2:
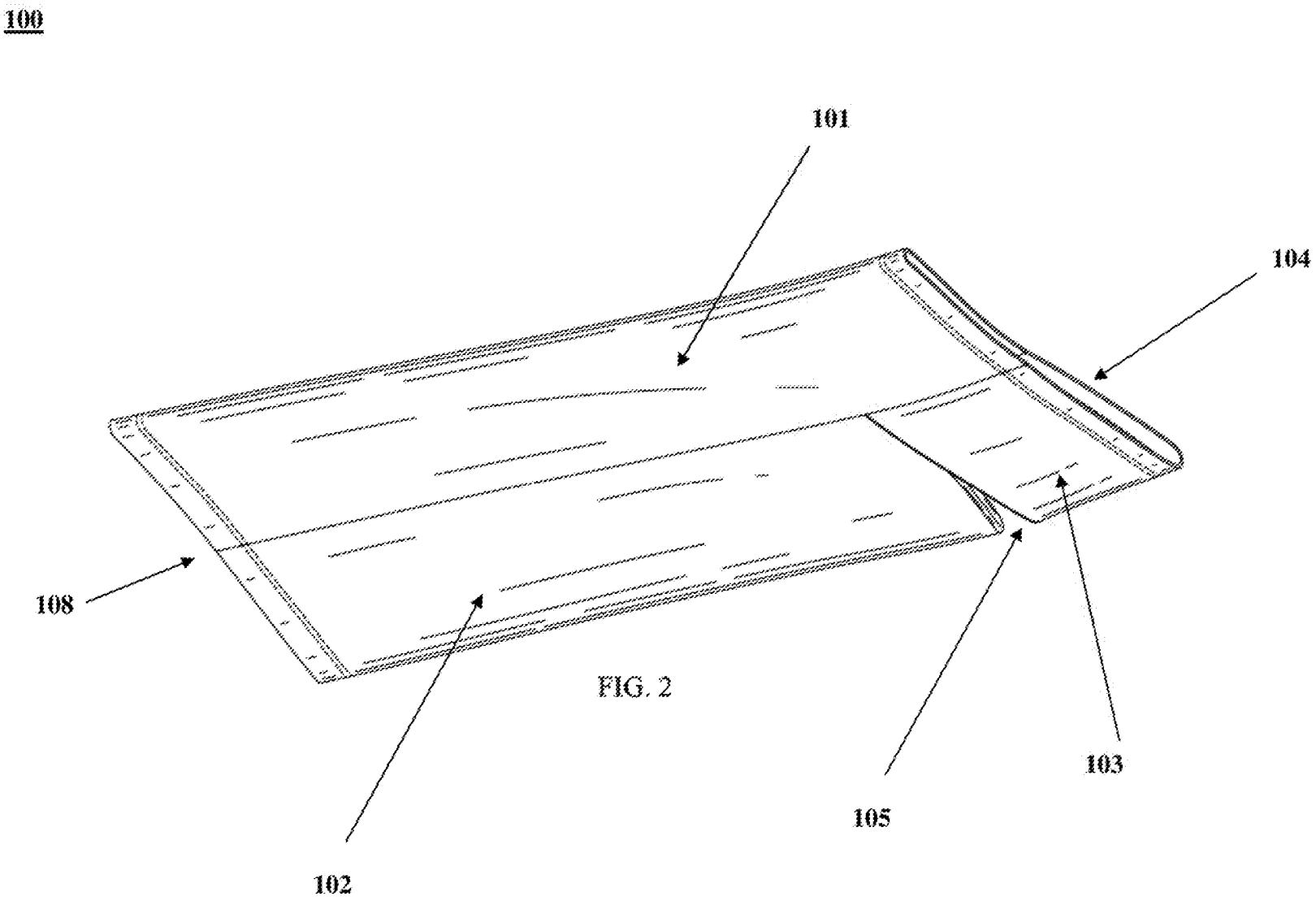
FIG. 2 is a right side perspective view of a skin protecting garment according to an exemplary embodiment of the present invention.
Figure 3:
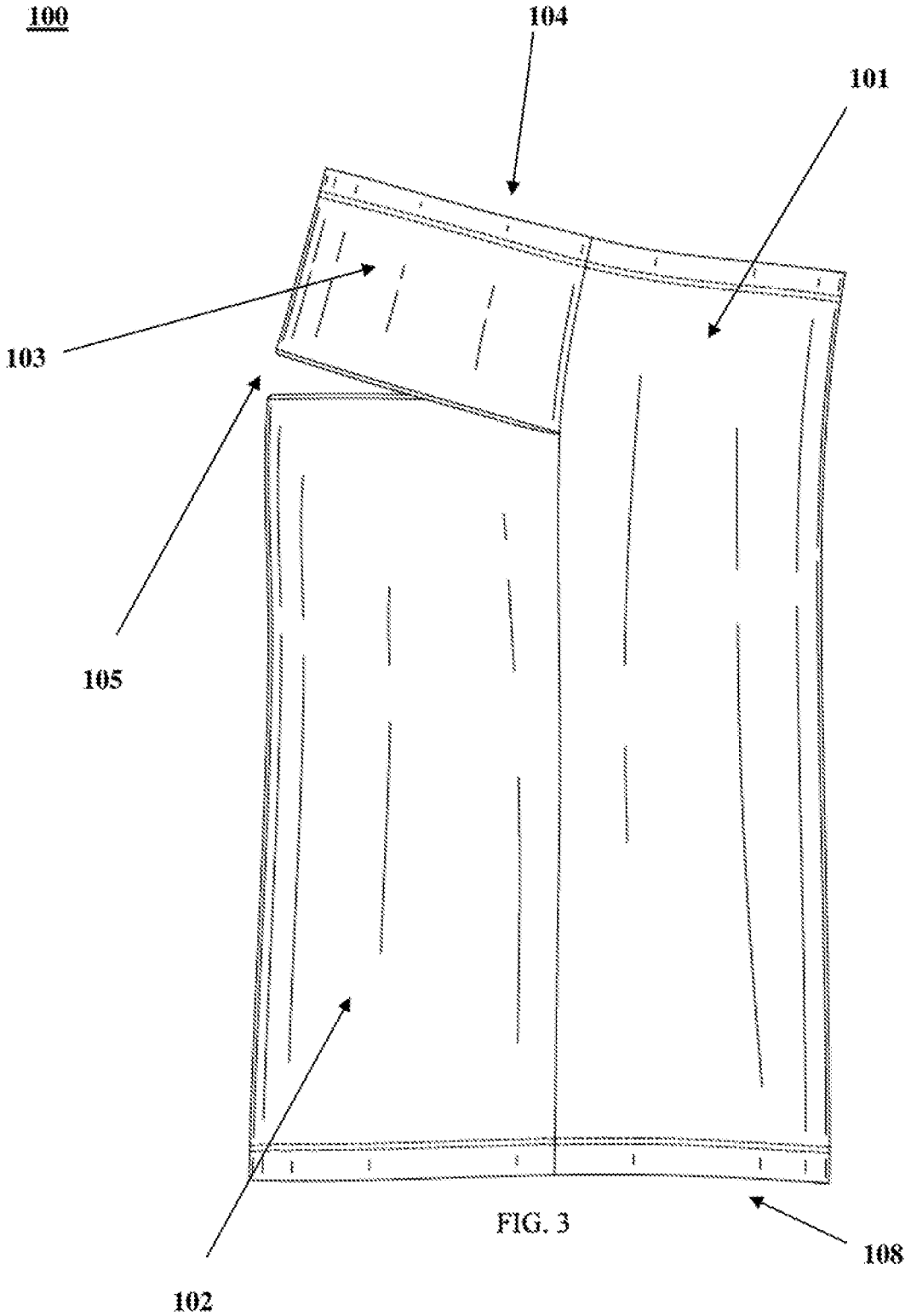
FIG. 3 is a left side view of a skin protecting garment according to an exemplary embodiment of the present invention.
Figure 4:
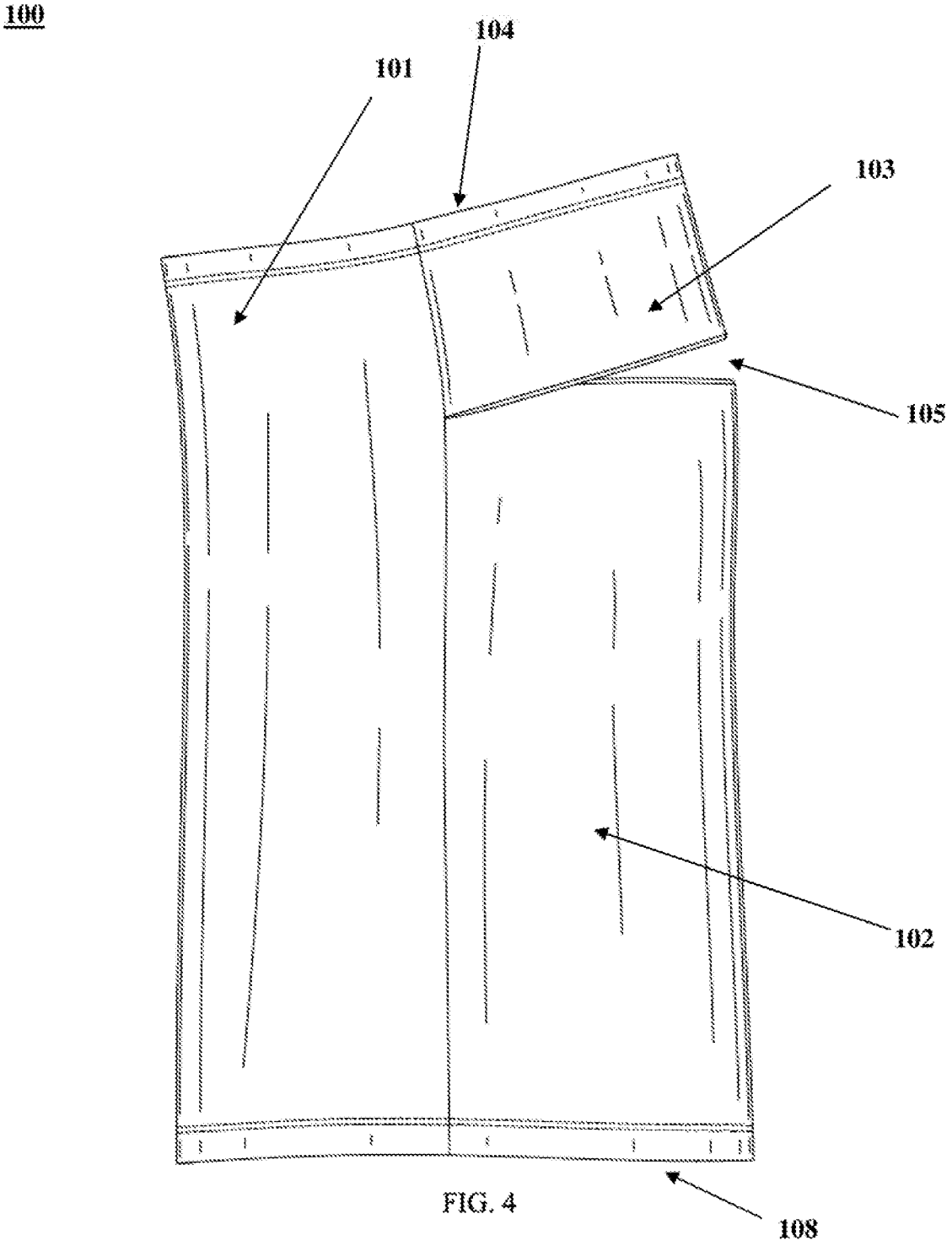
FIG. 4 is a right side view of a skin protecting garment according to an exemplary embodiment of the present invention.
Figure 5:
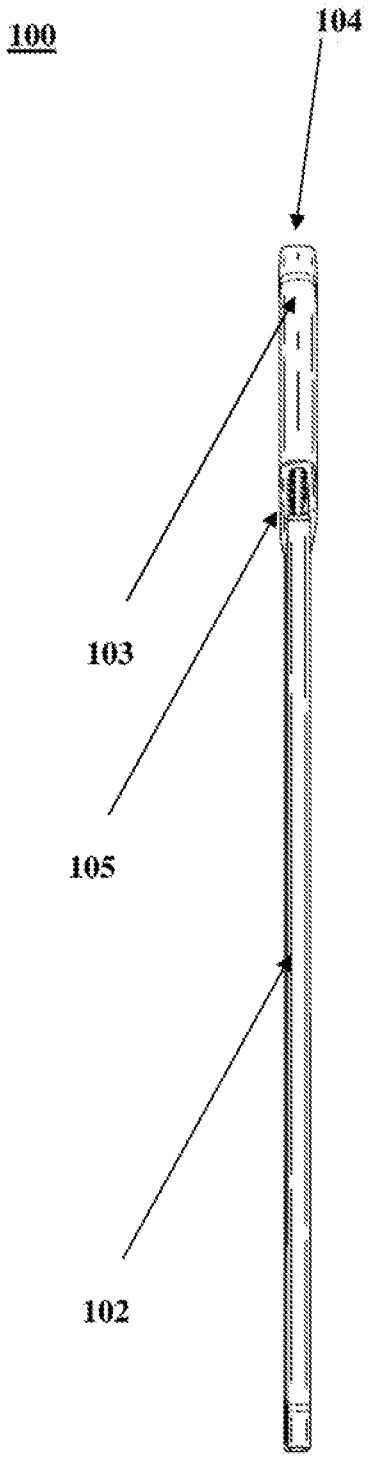
FIG. 5 is a front view of a skin protecting garment according to an exemplary embodiment of the present invention.
Figure 6:
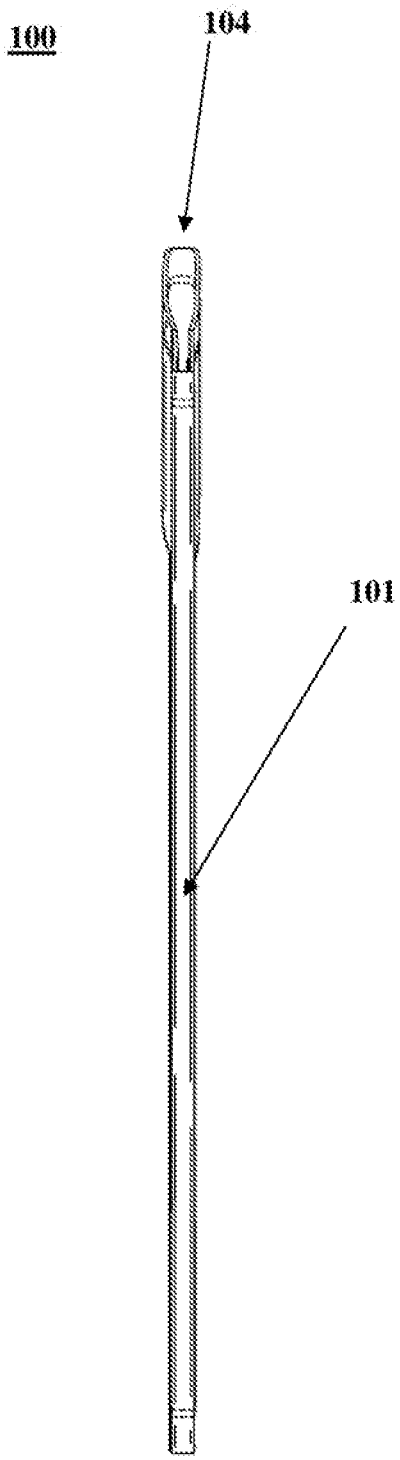
FIG. 6 is a rear view of a skin protecting garment according to an exemplary embodiment of the present invention.
Figure 7:
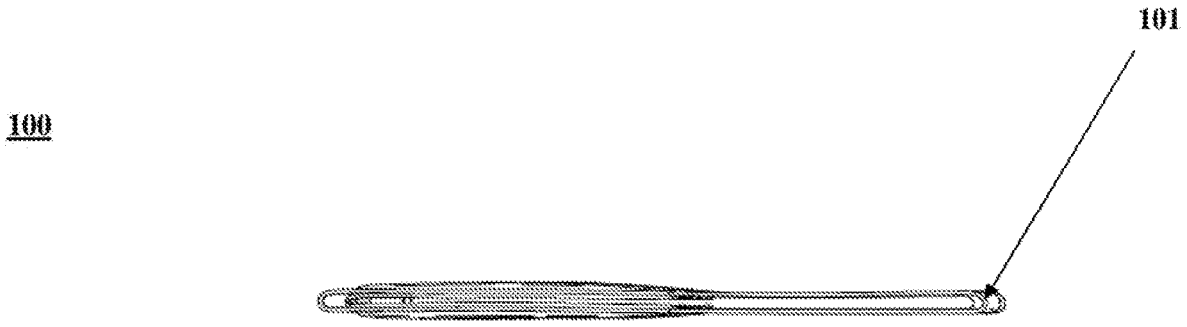
FIG. 7 is a bottom view of a skin protecting garment according to an exemplary embodiment of the present invention.
Figure 8:
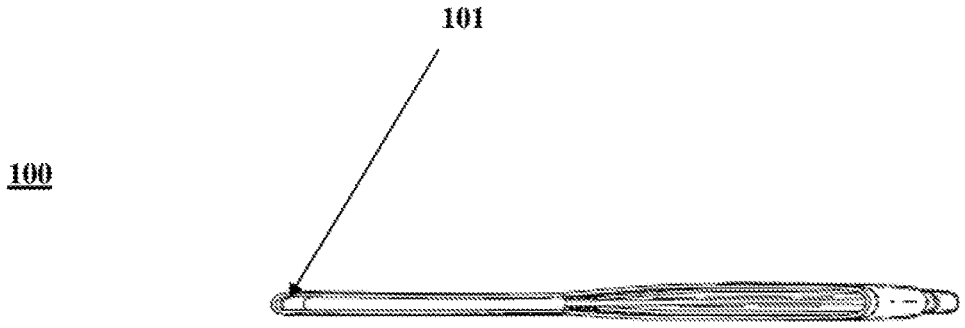
FIG. 8 is a top view of a skin protecting garment according to an exemplary embodiment of the present invention.
Figure 9:
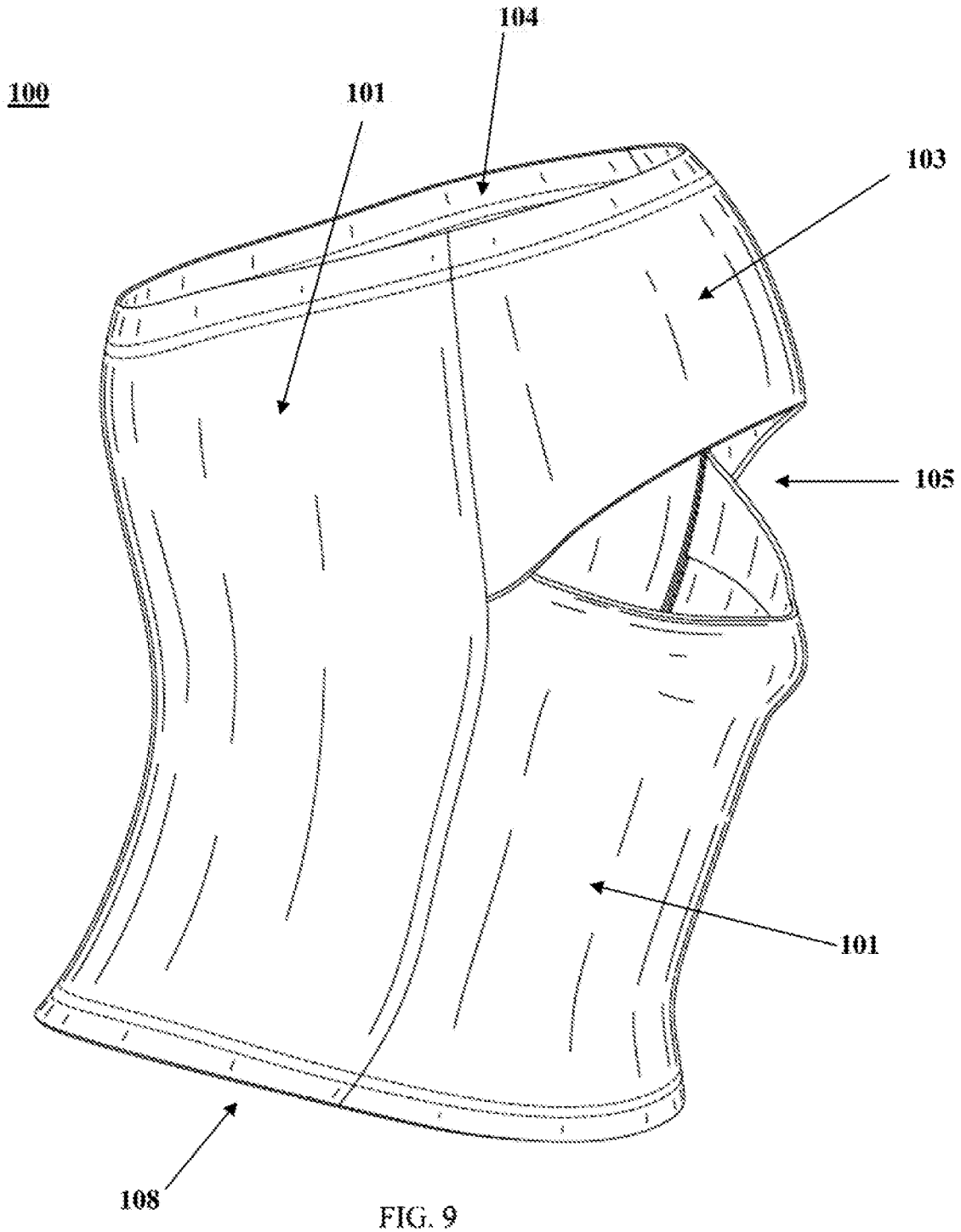
FIG. 9 is a right side perspective view of a skin protecting garment according to an exemplary embodiment of the present invention.
Figure 10:
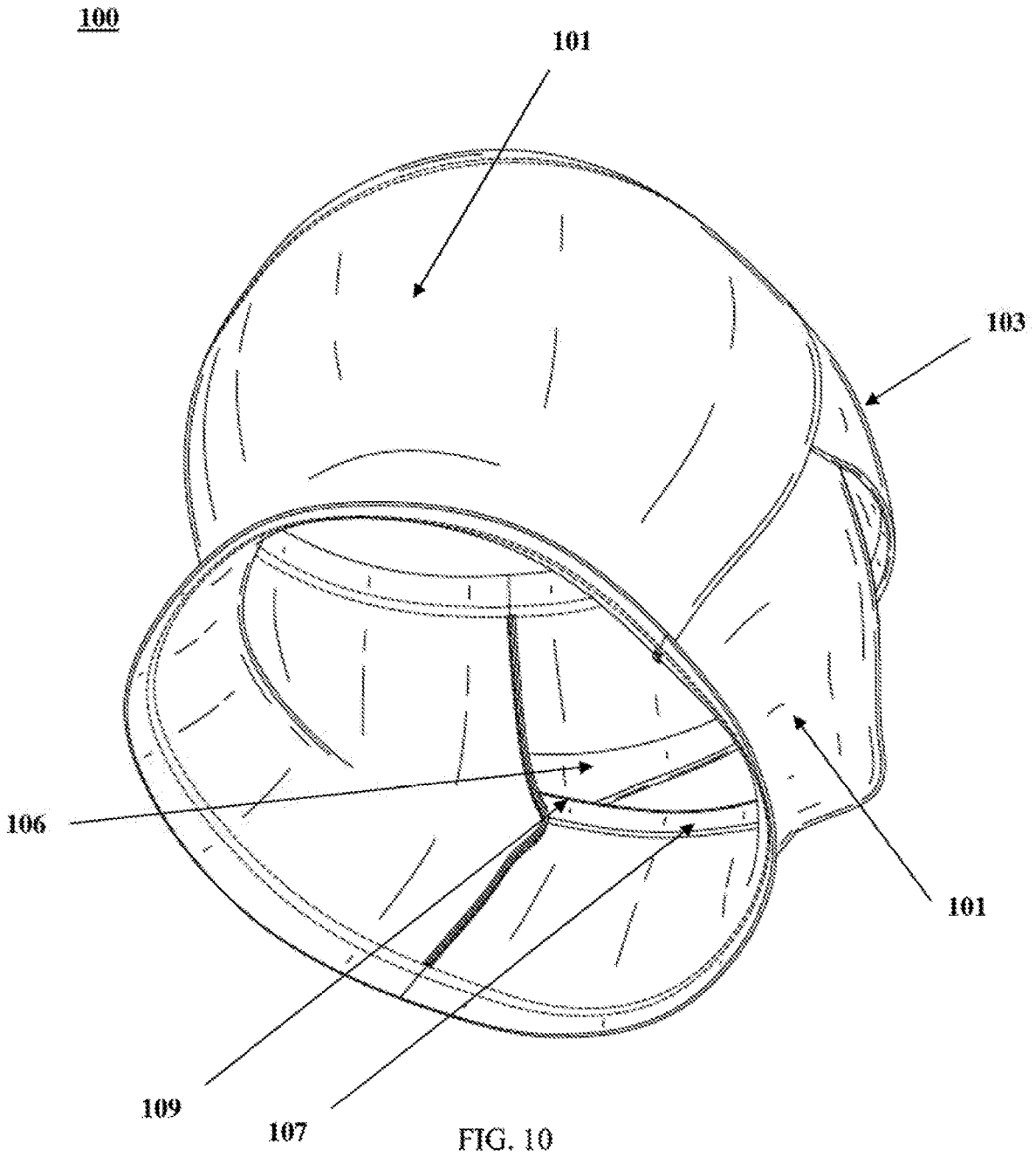
FIG. 10 is a right side perspective view of a skin protecting garment according to an exemplary embodiment of the present invention.
Figure 11:
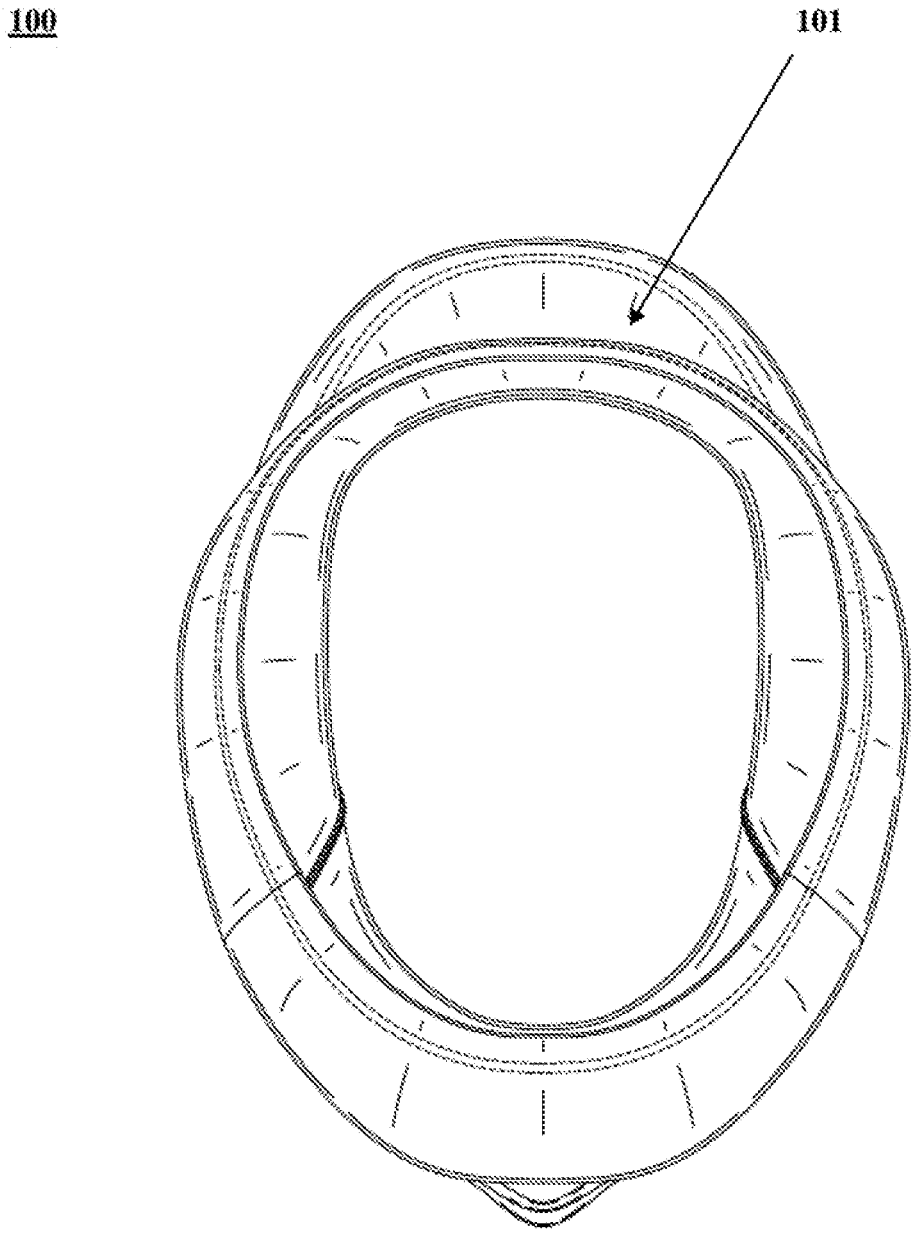
FIG. 11 is a bottom view of a skin protecting garment according to an exemplary embodiment of the present invention.
Figure 12:
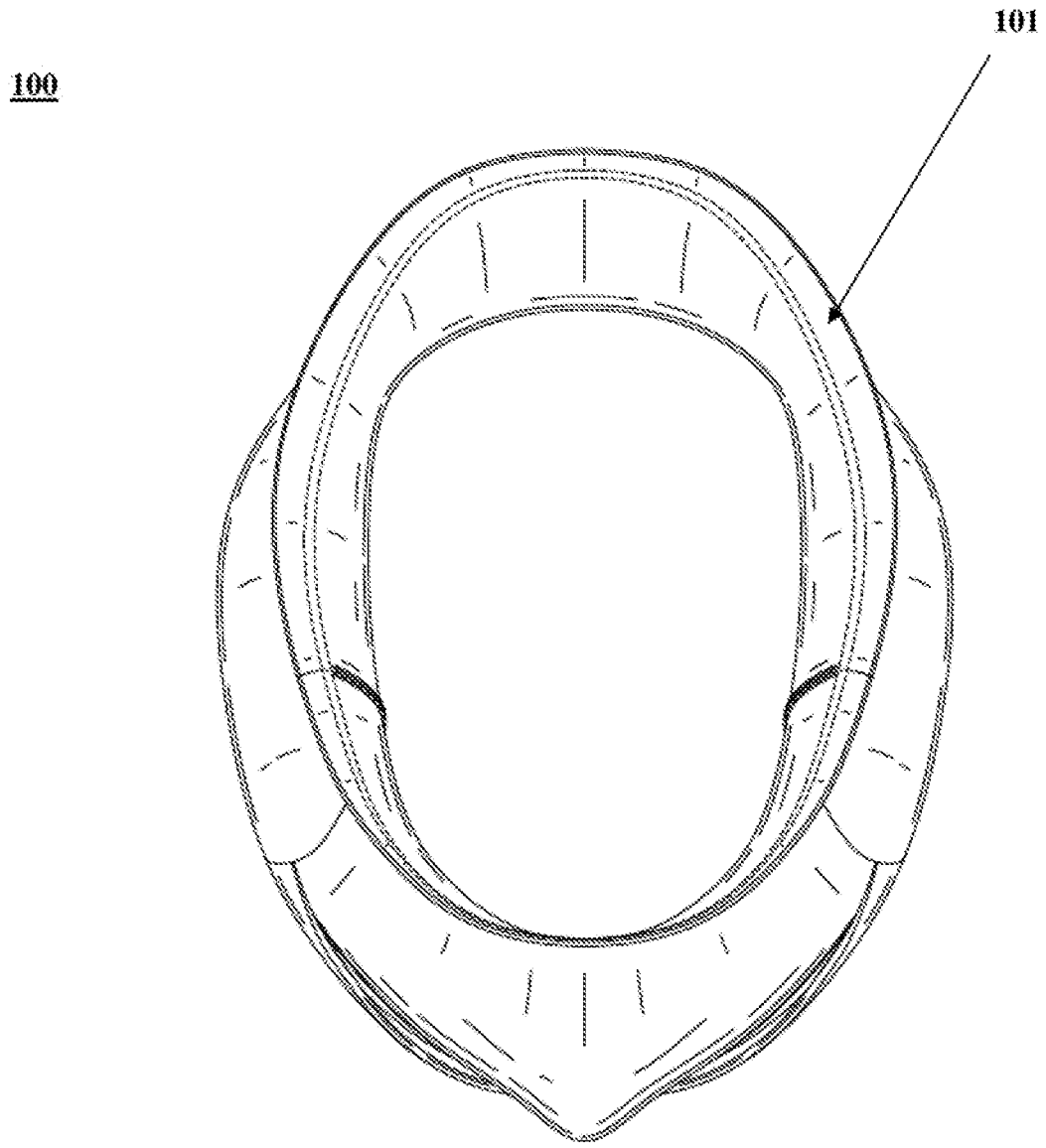
FIG. 12 is a top view of a skin protecting garment according to an exemplary embodiment of the present invention.
Figure 13:
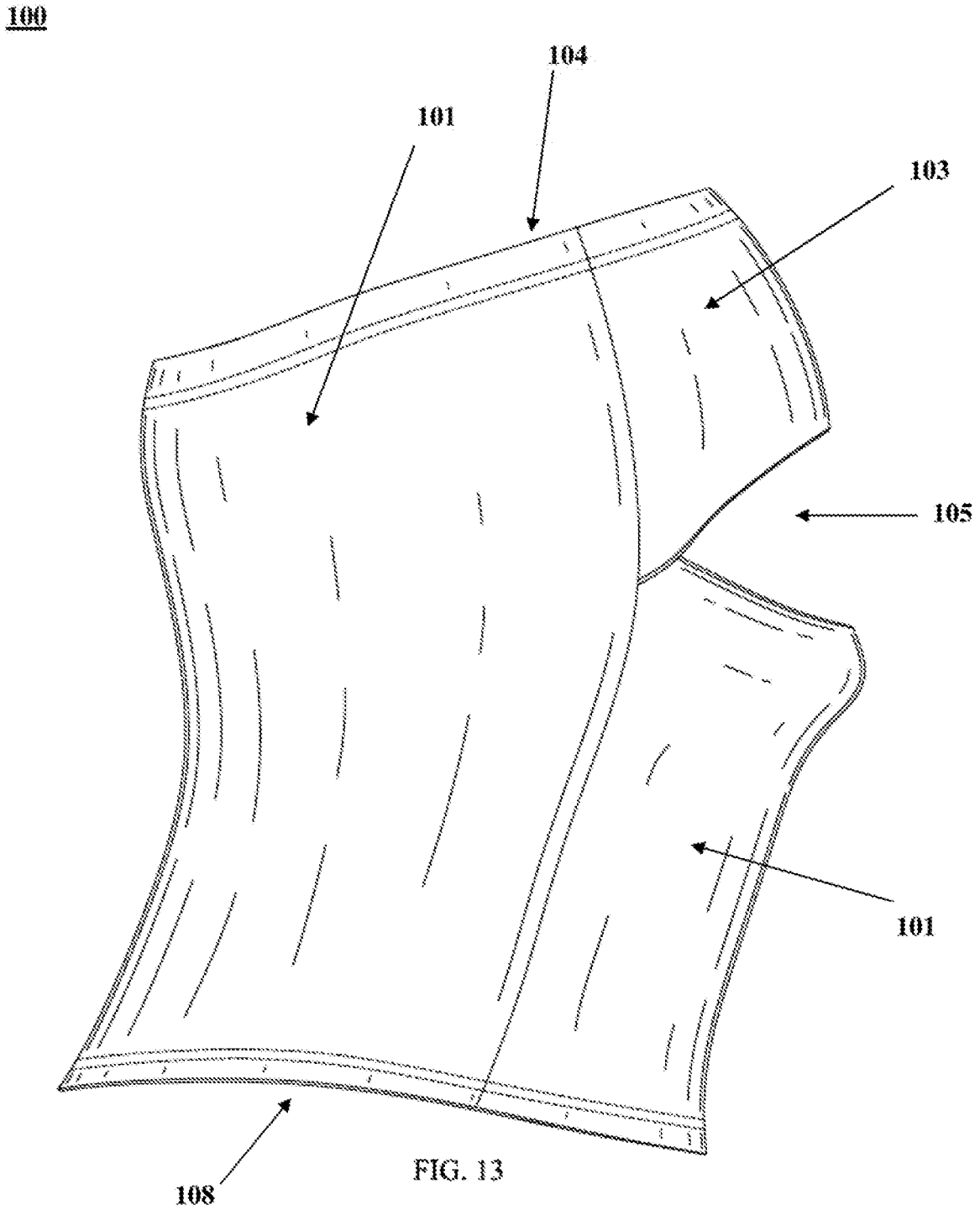
FIG. 13 is a right side view of a skin protecting garment according to an exemplary embodiment of the present invention.
Figure 14:
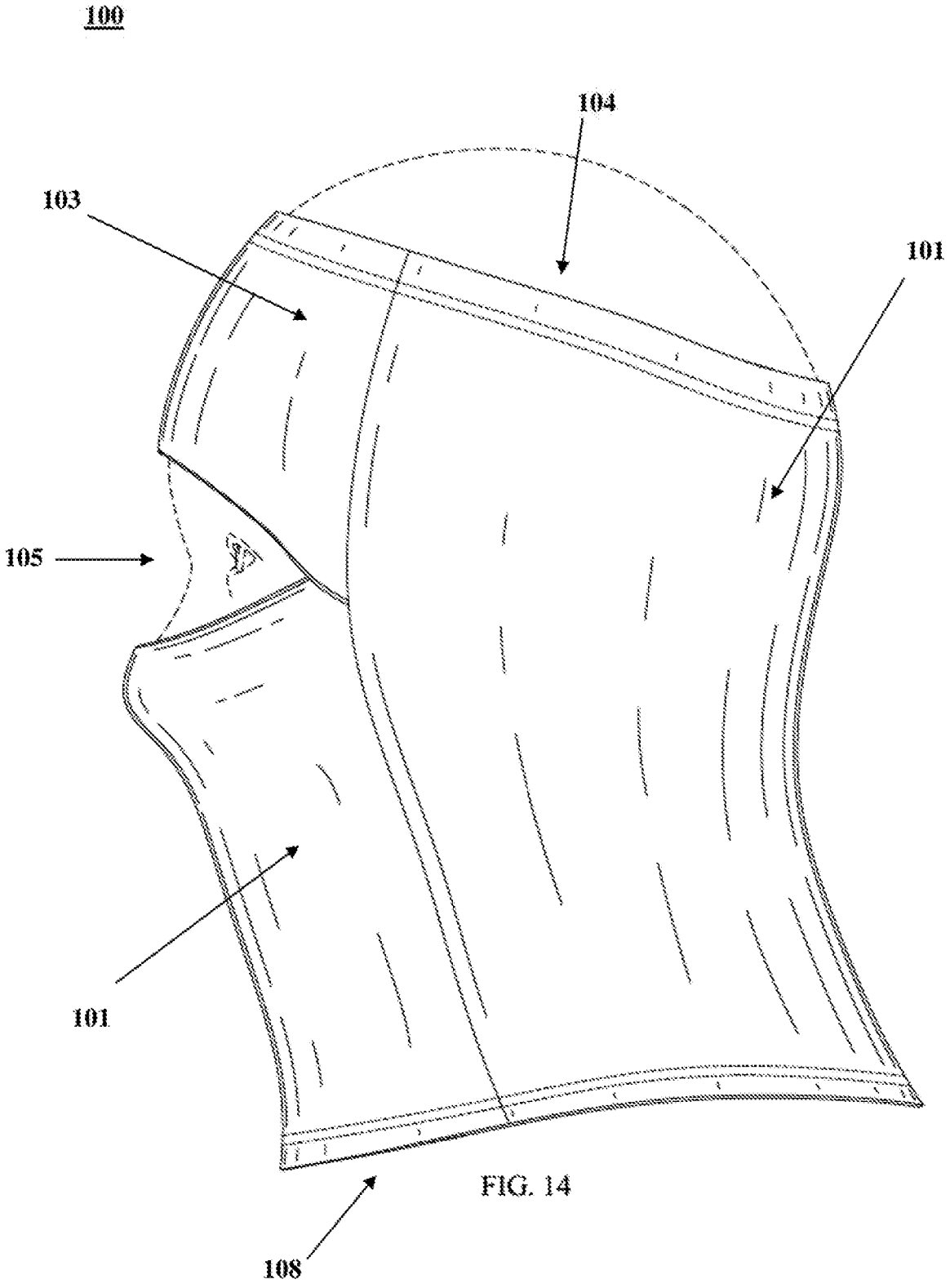
FIG. 14 is a left side view of a skin protecting garment according to an exemplary embodiment of the present invention on a wearer's head.
Figure 15:
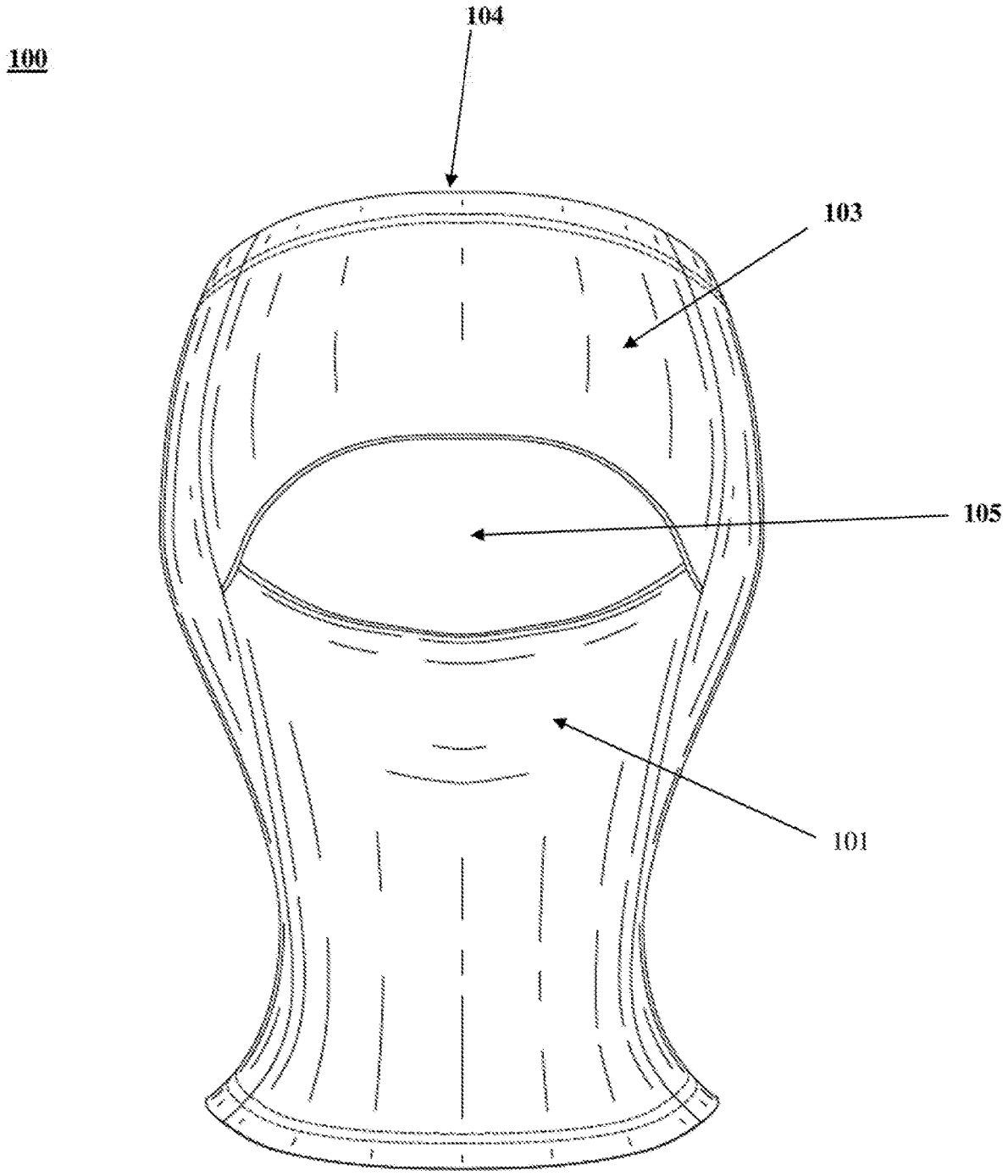
FIG. 15 is a front view of a skin protecting garment according to an exemplary embodiment of the present invention on a wearer's head.
Figure 16:
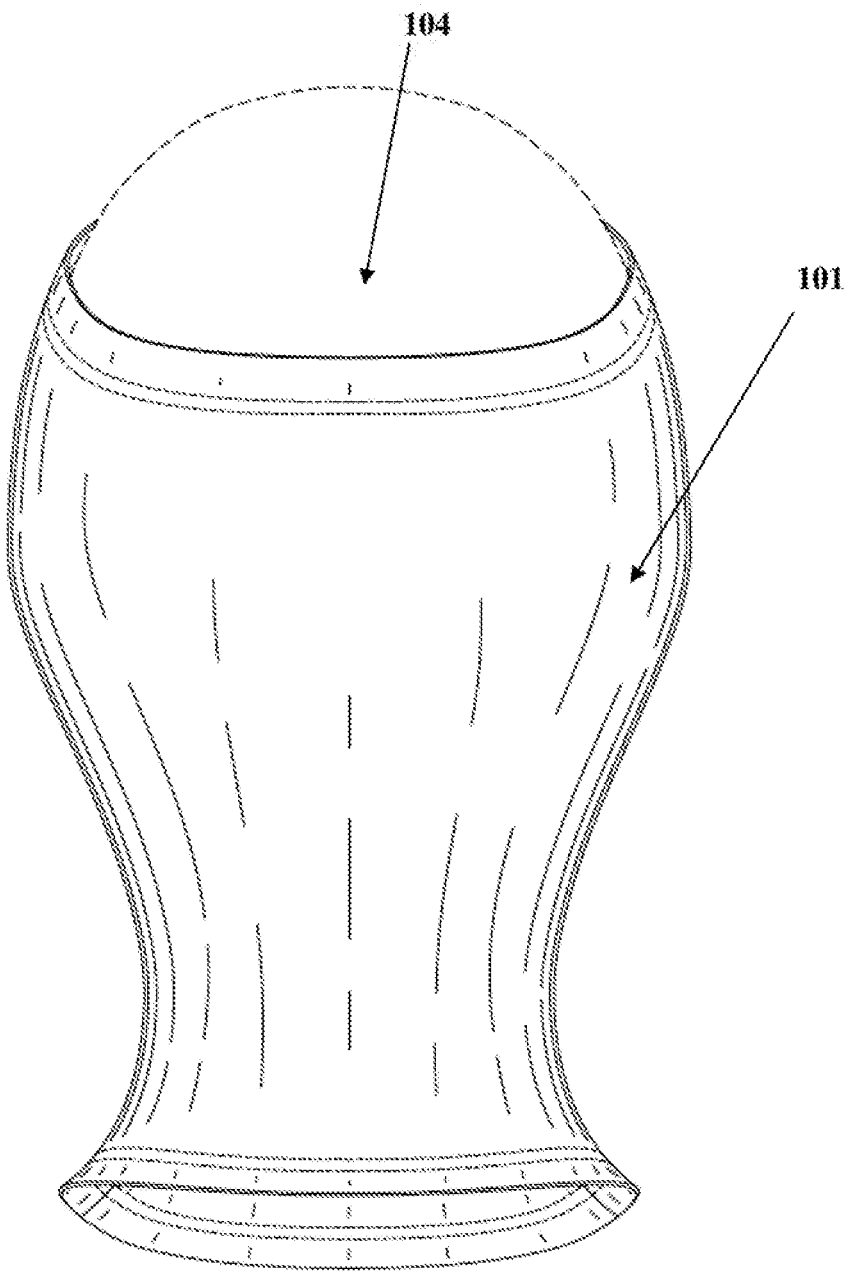
FIG. 16 is a rear view of a skin protecting garment according to an exemplary embodiment of the present invention on a wearer's head.

FIG. 1 is a perspective view of a skin protecting garment according to an exemplary embodiment of the present invention. FIG. 2 is a right side perspective view of a skin protecting garment according to an exemplary embodiment of the present invention. FIG. 3 is a left side view of a skin protecting garment according to an exemplary embodiment of the present invention. FIG. 4 is a right side view of a skin protecting garment according to an exemplary embodiment of the present invention. FIG. 5 is a front view of a skin protecting garment according to an exemplary embodiment of the present invention. FIG. 6 is a rear view of a skin protecting garment according to an exemplary embodiment of the present invention. FIG. 7 is a bottom view of a skin protecting garment according to an exemplary embodiment of the present invention. FIG. 8 is a top view of a skin protecting garment according to an exemplary embodiment of the present invention. FIG. 9 is a right side perspective view of a skin protecting garment according to an exemplary embodiment of the present invention. FIG. 10 is a right side perspective view of a skin protecting garment according to an exemplary embodiment of the present invention. FIG. 11 is a bottom view of a skin protecting garment according to an exemplary embodiment of the present invention. FIG. 12 is a top view of a skin protecting garment according to an exemplary embodiment of the present invention. FIG. 13 is a right side view of a skin protecting garment according to an exemplary embodiment of the present invention. FIG. 14 is a left side view of a skin protecting garment according to an exemplary embodiment of the present invention on a wearer's head. FIG. 15 is a front view of a skin protecting garment according to an exemplary embodiment of the present invention on a wearer's head. FIG. 16 is a rear view of a skin protecting garment according to an exemplary embodiment of the present invention on a wearer's head.

Referring to FIGS. 1 to 16, according to an exemplary embodiment of the present invention, a skin protecting garment 100 includes a back panel 101, a lower front panel 102 coupled to the back panel 101, and an upper front panel 103 coupled to the back panel 101. An upward facing opening 104 is formed by the back panel 101 and the upper front panel 103. The upward facing opening 104 is dimensioned, shaped and positioned to expose a top of a user's head. A forward facing slit 105 is between the lower front panel 102 and the upper front panel 103. The forward facing slit 105 is dimensioned, shaped and positioned to expose the user's eyes. The back panel 101, the lower front panel 102 and the upper front panel 103 are each formed of a material configured to block ultraviolet (UV) light.

According to an exemplary embodiment of the present invention, at least a portion of the upper front panel 103 may overlap at least a portion of the lower front panel 102. Thus, the upper front panel 103 may be adjusted to fit varying head sizes and hair styles. The upper front panel 103 may be dimensioned, shaped and positioned to cover a user's forehead, while exposing a user's eyes. At least a portion of the user's forehead may be exposed by adjusting a position of the upper front panel 103 upward or downward.

The lower front panel 102 may cover the user's mouth and/or nose. The position of the lower front panel 102 is adjustable to fit faces of varying sizes and the expose all or part of the user's mouth.

According to an exemplary embodiment of the present invention, the lower front panel 102 may have a different configuration than the upper and back panels 101 to allow a user to breathe relatively easily through the lower front panel 102. For example, the lower front panel 102 may include an interior and an exterior layer. At least one of the interior and exterior layers may have a reduced thickness with respect to the upper front panel 103 and the back panel 101, which may increase breathability of the lower front panel 102 covering the user's mouth and nose. Additionally, at least one of the interior and exterior layers may have a different polyester blend than the upper front panel 103 and the back panel 101 to increase breathability of the lower front panel 102.

According to an exemplary embodiment of the present invention, the material configured to block UV light may have an ultraviolet protection factor (UPF) of at least 40.

According to an exemplary embodiment of the present invention, the material configured to block UV light may have an ultraviolet protection factor (UPF) of at least 50.

According to an exemplary embodiment of the present invention, the material configured to block UV light may have an ultraviolet protection factor (UPF) of from about 15 to about 24.

According to an exemplary embodiment of the present invention, the material configured to block UV light may have an ultraviolet protection factor (UPF) of from about 25 to about 39.

According to an exemplary embodiment of the present invention, a skin protecting garment 100 a back panel 101. The back panel 101 is a single continuous textile article including a material configured to block ultraviolet (UV) light. A lower front panel 102 is coupled to the back panel 101. The lower front panel 102 includes the material configured to block UV light. An upper front panel 103 is coupled to the back panel 101. The upper front panel 103 includes the material configured to block UV light. An upward facing opening 104 is formed by the back panel 101 and the upper front panel 103. The upward facing opening 104 is dimensioned, shaped and positioned to expose a top of a user's head. A forward facing slit 105 is between the lower front panel 102 and the upper front panel 103. The forward facing slit 105 is dimensioned, shaped and positioned to expose the user's eyes.

The skin protecting garment 100 according to an exemplary embodiment of the present invention may include a downward facing opening 108 shaped and dimensioned to receive a user's head when the skin protecting garment 100 is applied to a user's head.

Referring to FIG. 10, the skin protecting garment 100 according to an exemplary embodiment of the present invention may include an upper folded portion 106 and a lower folded portion 107. The upper folded portion 106 may be formed by folding over a portion of the upper front panel 103. Thus, the upper folded portion 106 may include a double layer of fabric. The lower folded portion 107 may be formed by folding over a portion of the lower front panel 102. Thus, the lower folded portion 107 may include a double layer of fabric. The double layers of fabric in the upper folded portion 106 and the lower folded portion 107 may increase a thickness of the fabric to allow the forward facing slit 105 to be adjusted because the double layers of fabric may more securely hold to a user's face.

As an example, the upper folded portion 106 may be positioned on a front surface of a user's hat with the brim of the hat protruding through the forward facing slit 105. Thus, the double layer of fabric included in the upper folded portion 106 may more securely hold to a user's hat.

The upper folded portion 106 and the lower folded portion 107 may overlap each other to form an overlapping portion 109. Overlapping portions 109 may be positioned at opposite corners of the forward facing slit 105. The overlapping portions 109 may allow adjustment of the upper folded portion 106 and the lower folded portion 107 to modify the size of the forward facing slit 105 without causing damage (e.g., a tear or rip) in the fabric used to form the skin protecting garment 100. For example, damage to the overlapping portions 109 may be prevented. Additionally, UV rays may be more effectively blocked by employing the overlapping portions 109, such as when the upper folded portion 106 and the lower folded portion 107 are adjusted to form a relatively large forward facing slit 105.

A method of manufacturing a skin protecting garment 100 according to an exemplary embodiment of the present invention will be described in more detail below.

According to an exemplary embodiment of the present invention, the material configured to block UV light may include at least one of cotton, nylon, a fabric blend, polyester or microfiber. As an example, the material configured to block UV light maybe a pure polyester fabric having a UV rating, as described herein. Alternatively, the material configured to block UV light may be a polyester blended with another fabric, at least one of which has a UV rating, as described herein.

According to an exemplary embodiment of the present invention, at least one of the back panel 101, the lower front panel 102 and the upper front panel 103 may include a moisture-wicking material.

According to an exemplary embodiment of the present invention, at least one of the back panel 101, the lower front panel 102 and the upper front panel 103 may include a fleece material. The fleece material may be relatively warm for use in cold weather conditions such as skiing or snowboarding.

According to an exemplary embodiment of the present invention, at least one of the back panel 101, the lower front panel 102 and the upper front panel 103 may include an organic cotton/spandex blend, a bamboo/spandex blend or an acetate/polyester blend; however, exemplary embodiments are not limited thereto.

The skin protecting garment 100 according to an exemplary embodiment of the present invention may be manufactured according to the following procedure; however, exemplary embodiments are not limited thereto.

Three separate pieces, 2 pieces measuring 11"×22" & 1 piece measuring 11"×6.5" are cut from a larger section of fabric. Alternatively, 2 pieces measuring 11"×16" & 1 piece measuring 11"×6.5" may be cut from the larger section of fabric One full-length piece facing pattern side up laid down flat.

Smaller piece (headband piece) laid non-pattern side up on top of already laid fabric at one end. Folding the interior fabric edge in 2" to create useable excess fabric (to make headband larger or smaller).

Longer piece lay on opposite end, non-pattern side up, on top of all the pieces. Then folded down (on headband piece end) 3.5" to create excess fabric.

Pin all long edges and sew using thicker sewing pattern—sewing 9.5" apart.

Cut away excess on ends.

The disclosures of each of the references, patents and published patent applications disclosed herein are each incorporated by reference herein in their entireties.

In the event of a conflict between a definition herein and a definition incorporated by reference, the definition provided herein is intended.

Having described exemplary embodiments of the present invention, it is further noted that it is readily apparent to those of ordinary skill in the art that various modifications may be made without departing from the spirit and scope of the present invention.

What is claimed is:

1. A skin protecting garment, comprising:

a back panel;

a lower front panel coupled to the back panel;

an upper front panel coupled to the back panel;

an upward facing opening formed by the back panel and the upper front panel, wherein the upward facing opening is dimensioned, shaped and positioned to expose a top of a user's head; and a forward facing slit between the lower front panel and the upper front panel, wherein the forward facing slit is dimensioned, shaped and positioned to expose the user's eyes, wherein a first side of the upper front panel overlaps a first side of the lower front panel at a first corner of the forward facing slit, and a second side of the upper front panel overlaps a second side of the lower front panel at a second side of the forward facing slit, and wherein the back panel, the lower front panel and the upper front panel are each formed of a material configured to block ultraviolet (UV) light.

2. The skin protecting garment of claim 1, wherein the material configured to block UV light has an ultraviolet protection factor (UPF) of at least 40.

3. The skin protecting garment of claim 1, wherein the material configured to block UV light has an ultraviolet protection factor (UPF) of at least 50.

4. The skin protecting garment of claim 1, wherein the material configured to block UV light has an ultraviolet protection factor (UPF) of from about 15 to about 24.

5. The skin protecting garment of claim 1, wherein the material configured to block UV light has an ultraviolet protection factor (UPF) of from about 25 to about 39.

6. The skin protecting garment of claim 1, wherein the material configured to block UV light includes at least one of cotton, nylon, a fabric blend, polyester or microfiber.

7. The skin protecting garment of claim 1, wherein at least one of the back panel, the lower front panel and the upper front panel includes a moisture-wicking material.

8. A skin protecting garment, comprising:

a back panel, wherein the back panel is a single continuous textile article comprising a material configured to block ultraviolet (UV) light;

a lower front panel coupled to the back panel, wherein the lower front panel comprises the material configured to block UV light;

an upper front panel coupled to the back panel, wherein the upper front panel comprises the material configured to block UV light;

an upward facing opening formed by the back panel and the upper front panel, wherein the upward facing opening is dimensioned, shaped and positioned to expose a top of a user's head; and a forward facing slit between the lower front panel and the upper front panel, wherein the forward facing slit is dimensioned, shaped and positioned to expose the user's eyes, wherein a first side of the upper front panel overlaps a first side of the lower front panel at a first corner of the forward facing slit, and a second side of the upper front panel overlaps a second side of the lower front panel at a second side of the forward facing slit.

9. The skin protecting garment of claim 8, wherein the material configured to block UV light has an ultraviolet protection factor (UPF) of at least 40.

10. The skin protecting garment of claim 8, wherein the material configured to block UV light has an ultraviolet protection factor (UPF) of at least 50.

11. The skin protecting garment of claim 8, wherein the material configured to block UV light has an ultraviolet protection factor (UPF) of from about 15 to about 24.

12. The skin protecting garment of claim 8, wherein the material configured to block UV light has an ultraviolet protection factor (UPF) of from about 25 to about 39.

13. The skin protecting garment of claim 8, wherein the material configured to block UV light includes at least one of cotton, nylon, a fabric blend, polyester or microfiber.

14. The skin protecting garment of claim 8, wherein at least one of the continuous back panel, the lower front panel and the upper front panel includes a moisture-wicking material.

* * * * *